US012716169B2

(12) United States Patent
Wallis et al.

(10) Patent No.: US 12,716,169 B2
(45) Date of Patent: Aug. 25, 2026

(54) PLANT BASED ANTI-MICROBIAL FABRIC TREATMENT, TREATED FABRICS, AND ASSOCIATED METHODS

(71) Applicant: Noble BioMaterials, Inc., Scranton, PA (US)

(72) Inventors: Jodi Wallis, Carbondale, PA (US); Lynn Wagner, Carlsbad, CA (US); Joel Furey, Stowe, VT (US); Lou Protonentis, Raleigh, NC (US)

(73) Assignee: Noble BioMaterials, Inc., Scranton, PA (US)

( * ) Notice: Subject to any disclaimer, the term of this patent is extended or adjusted under 35 U.S.C. 154(b) by 0 days.

(21) Appl. No.: 17/734,784

(22) Filed: May 2, 2022

(65) Prior Publication Data

US 2022/0349117 A1 Nov. 3, 2022

Related U.S. Application Data

(60) Provisional application No. 63/182,548, filed on Apr. 30, 2021.

(51) Int. Cl.

| | |
|---|---|
| ***D06M 15/263*** | (2006.01) |
| ***D06M 23/04*** | (2006.01) |
| *D06M 101/06* | (2006.01) |

(52) U.S. Cl.

CPC ..... *D06M 15/263* (2013.01); *D06M 23/04* (2013.01); *D06M 2101/06* (2013.01)

(58) Field of Classification Search

None

See application file for complete search history.

(56) References Cited

U.S. PATENT DOCUMENTS

| | | | | |
|---|---|---|---|---|
| 6,343,395 | B1 * | 2/2002 | Schrell | D06B 3/28 68/19 |
| 2006/0070189 | A1 * | 4/2006 | Raehse | C11D 3/48 8/115.51 |
| 2006/0194708 | A1 * | 8/2006 | Barthel | C11D 17/0073 510/337 |
| 2019/0169793 | A1 * | 6/2019 | Quinlan | D06M 15/564 |

FOREIGN PATENT DOCUMENTS

| | | | | |
|---|---|---|---|---|
| JP | H0959868 | A | 3/1997 | |
| KR | 20160092102 | A * | 8/2016 | |
| WO | WO-9317558 | A1 * | 9/1993 | A01N 65/00 |
| WO | 2010129489 | A2 | 11/2010 | |

OTHER PUBLICATIONS

Boruga, O., et al., "Thymus vulgaris essential oil: chemical composition and antimicrobial activity", Journal of Medicine and Life, 2014, pp. 56-60, vol. 7, Special Issue 3.

International Preliminary Report on Patentability in PCT/US2022/027310, mailed Oct. 24, 2023, 6 pages.

Examination Report in GB2300047.4, dated Oct. 11, 2024, 1 page.

* cited by examiner

*Primary Examiner* — Michael P. Rodriguez

(74) *Attorney, Agent, or Firm* — Lewis Rice LLC

(57) ABSTRACT

A process, and the resultant product, for effectively binding plant-based antimicrobials to various fabrics which process provides for long term antimicrobial effect of the fabric.

19 Claims, 1 Drawing Sheet

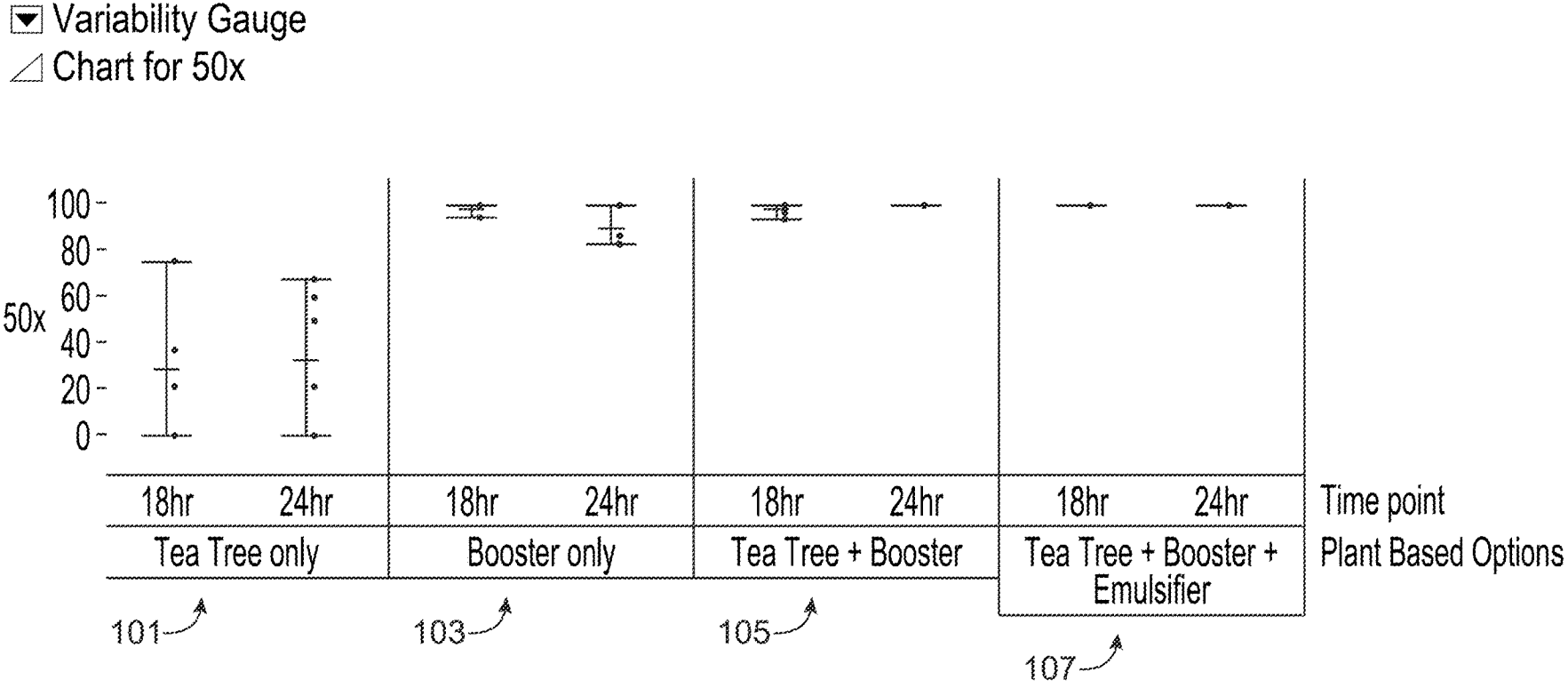
Variability Gauge
Chart for 50x
50x
100
80
60
40
20
0
18hr
24hr
Tea Tree only
Booster only
Tea Tree + Booster
Tea Tree + Booster + Emulsifier
Time point
Plant Based Options
101
103
105
107

PLANT BASED ANTI-MICROBIAL FABRIC TREATMENT, TREATED FABRICS, AND ASSOCIATED METHODS

CROSS REFERENCE TO RELATED APPLICATION(S)

This Application claims the benefit of U.S. Provisional Patent Application 63/182,548 filed Apr. 30, 2021, the entire disclosure of which is herein incorporated by reference.

BACKGROUND

1. Field of the Invention

This disclosure is related to the field of antimicrobial garments, fabrics, filaments, and staple fibers. Particularly to antimicrobial garments and fabrics which obtain their antimicrobial function from plant-based compounds and maintain antimicrobial function through laundering.

2. Description of the Related Art

The world is full of microorganisms. While many of these are beneficial, or even necessary, for human survival, a large number are, in fact, detrimental and downright dangerous to humans. It has long been recognized that a large number of human maladies can be traced to microorganisms and specifically viruses and bacteria. Maladies such as COVID-19, influenza, malaria, staphylococcus (staph), athlete's foot, and even the common cold can be traced to microorganisms or antigens acting on the human body.

Outside of recognized disease, even more common, but undesirable, conditions such as body odor can be traced to microorganisms. While conditions such as body odor are far from life threatening, they are undesirable and can cause stress and anxiety. As humans are social creatures, body odor which is not controlled is typically considered undesirable and can have major social implications. Further, while odor is essential for scent-based animals to identify each other, as humans are generally considered a sight-based species, the failure to control body odor is often seen as an indicator of lower social rank. Because of this, while many may think it is an unnecessary action, reducing body odor is indelibly a part of modern human life.

The reduction of human odor comes from a variety of places. Much human odor comes from sweat, which, while inherently odorless, is broken down by microorganisms (typically bacteria) on human skin which convert certain proteins to acids. These bacteria, and the chemical process performed, do emit odor. For this reason, areas where sweat is most present (for example the armpits) are both washed regularly, but also often treated with substances to inhibit sweating, to conceal odor, or kill the bacteria present. These substances are often placed directly on the skin but for some people that can lead to rashes and irritation. However, because humans are essentially the only animals that wear clothes, sweat can also become trapped in the fabric of our clothes which can emit odor either when worn again, or even long after having been removed. This is well known from the scent of dirty socks in a laundry hamper but is also very common in exercise or workout clothes which often are exposed to greatly increased amounts of sweat.

The primary issue encountered with microorganisms is that they are everywhere, and it is often difficult to separate the good from the bad. Part of the reason humans may find body odor noxious or offensive is because we associate it with potential danger. For example, most humans react negatively to the smell of rotting meat. This could very easily have been a defensive evolution so we do not eat it. Because of this, it is often desirable to simply separate humans, or at least certain parts of humans, from microorganisms as much as possible. While complete separation of humans and microorganisms would typically be fatal, separation in certain circumstances is often beneficial.

Separation from any microorganism can be particularly beneficial in situations where the human body is at an increased risk for infection. This can occur, for example, when the skin is broken (either by accident, or purposefully such as in surgery) or where a human has a decreased immune response due to age, immunosuppressant drugs, or other conditions. It can also be beneficial when the organism is external to our body and may be unneeded. This is the case in body odor where, while it is arguably unnecessary and cosmetic, removal can provide increased comfort and decreased stress and anxiety.

The human immune system is incredibly effective at destroying dangerous microorganisms which enter the body and supplies a multitude of different responses and attacks when the body is invaded by a non-recognized microorganism. However, even with this powerful response, there are microorganisms that the body can, and regularly does, miss. There is also the issue that while the body may respond to the presence of an antigen, the body may be unable to react fast enough to prevent the human host from suffering permanent injury or death. Further, many of our interactions with microorganisms actually occur outside the body. Our own body odor, for example, does not trigger the immune system as it external to the body. Instead, we react to it from sensing it from others, and sometimes from ourselves.

In order to assist the body in the destruction of harmful or simply annoying microorganisms, a variety of things are used to eliminate microorganisms not from within our bodies, but from around them. Because many forms of bacteria are dangerous, many of these products are specific antibacterial compounds which typically target specific features of bacteria to kill them off before they ever contact our bodies. We are all familiar with antibacterial soaps, hand sanitizers, and the like which are designed to kill bacteria on the hands to inhibit us from transferring them internal to our bodies via touching a body orifice such as by wiping the nose or simply eating. A concern with antibacterials is that while antibacterials can be very effective, they do not kill everything and can have the side-effect of allowing bacteria to evolve which are immune to particular antibacterials. For this reason, they are commonly used sparingly as too much use can result in bacteria evolving which are increasingly dangerous to humans and immune from the antibacterial.

Another classification of disinfectants are antimicrobials. Antimicrobials, and specifically, non-specific antimicrobials, have a major advantage over most antibiotics and other antigen specific compounds in that they often have a much greater lethality which can readily prevent the spread of resistant bacteria. Antimicrobials are effectively all destructive in that they do not specifically target bacteria, but are generally lethal to all or many forms of microscopic life. However, they are usually supplied in small amounts so that they are highly lethal to smaller organisms, but generally have little effect on megafauna. Certain antimicrobials, such as chlorine bleach, are so effective that they are readily accepted in widespread use.

The term "antimicrobial," however, is often also used specifically refer to products which are really antibiotic. For this reason, materials which are antimicrobial are often referred to based on how they are used relative to humans. For example, human surfaces and materials which are for use on human surfaces (e.g. the skin) are often referred to as antiseptic if they are broadly antimicrobial. Meanwhile, materials which are used to eradicate microorganisms on non-human surfaces are often referred to as disinfectants. Regardless of which term is used, the end result is typically the same. These types of materials are designed to destroy multiple types of microorganisms that they come in contact with. In effect, they are dilute poisons provided at a level which is lethal to microorganisms, but insufficient to affect the humans that use them. For this reason, one must often be careful with disinfectants so that the user does not take them internally or become exposed to them in high concentration.

There are a large number of broad-spectrum antimicrobials known to humans. Products such as chlorine bleach, hydrogen peroxide, forms of copper, silver and gold which act as a source for ions, alcohols, and iodine can be effective non-specific antimicrobials. The incorporation of these materials into a variety of products has, therefore, become increasingly commonplace. One can buy a plethora of disinfecting wipes, sprays, and sanitizers which include these substances and are designed to destroy microorganisms on the skin or on surfaces.

One area where such antimicrobial incorporation is seeing increased use is in fabrics and textiles. This can include such mundane uses as in socks or undergarments in order to destroy odor causing microbes, or in wound dressings where the human immune response is being given an aid in inhibiting dangerous microbes from entering the human body and potentially causing complications from an injury or medical procedure. Fabrics are a particularly valuable place to position antimicrobials as they are typically positioned close to (and typically on) humans, but do not involve the antimicrobial being placed directly on the skin. That means that the risk from absorption of the antimicrobial through the skin or from skin irritation from the antimicrobial can generally be reduced.

While the benefits of antimicrobial fabrics are becoming increasingly recognized and such products are becoming more and more common, there are also concerns arising about the antimicrobials being used. Many antimicrobials are generated through potentially dangerous chemical processes that can also produce undesirable and potentially toxic waste products. Further, some utilize relatively rare elements which are in limited supply and can be hard to obtain. Finally, even beyond the antimicrobial itself, the process of binding the antimicrobial to a fabric can also generate noxious waste.

A further problem exists in post-manufacture use in that an antimicrobial may be washed away by necessary exposure or laundering of a fabric. For example, fabric or yarn that has been impregnated with antimicrobials may have the particles held within spaces or interstices of the fabric or yarn. If the fabric or yarn is then used to absorb a liquid to expose the liquid to the antimicrobial, the liquid also competes to occupy the same space and interstice and may knock the antimicrobial particles loose so that they free float in the liquid. In some applications (such as in wound dressings), this may be perfectly acceptable or even desirable, but for other uses it can result in displacement of the antimicrobial to a location where its effect is lessened and can result in the antimicrobial effect being decreased with use, such as through repeated laundering. This is particularly an issue with the use of antimicrobials in fabric to inhibit body odor as these products are also often heavily laundered as they often become dirtier due to their sweat exposure.

Because of concerns about the long-term sustainability and availability of antimicrobials, there has recently been a push to move away from manmade synthetic chemicals produced via industrial chemical processes to reusing antimicrobials produced by other organisms. Organisms evolve in response to continued exposure to novel microbes and most produce their own defensive chemicals. These defensive chemicals can be reused by humans and allow for humans to gain the benefit of the organism's evolution against a novel microbe while simultaneously avoiding the need to produce chemicals via industrial processes. To avoid harming megafauna and other larger, and potentially more intelligent, animal species, there has been a particular push to use plant-based products.

Plants have typically been seen as a good source of raw materials. In the first instance, plants occur naturally or spontaneously on the earth and, as is often taught in early science classes, are effectively the opposite side of a continuing circle of life to humans and other animals. For example, many people learn in elementary school that humans use oxygen and expel carbon dioxide while plants take in carbon dioxide and expel oxygen. Thus, the two together can create a circular use of resources which is highly sustainable. For this reason, in recent years, there has been an increased push to have plants generate more materials useful to humans.

Humans have always used plants as raw materials. Wood was surely one of mankind's earliest building materials and it is known that many human cultures made fabrics and products from plant fibers. Plant fibers were also used in mined building materials such as clay to strengthen the resultant products. Even today, plants such as bamboo, cotton, wood (cellulose), and hemp are used in huge amounts as sources for fibers, wood is used in building and in the formation of paper, and large numbers of plants are consumed as food. However, in recent times plants have acquired increased interest as sources for alternatives to modern industrially created materials. For example, paper products are beginning to replace plastics which had often originally supplanted the paper products to begin with. Plants are also increasingly being seen as a source for useful chemicals which have otherwise been synthesized or obtained from minerals or similar geologic sources.

As discussed above, many antimicrobial compounds are essentially manufactured and many materials that use such compounds can be considered relatively toxic to megafauna as well. As a simple example, household cleaners often incorporate chlorine bleach, other chlorides, or peroxides which are dangerous to humans and other megafauna as well as being effective at killing microorganisms. These products often are forced to play a delicate dance of being effective at their primary purpose of eliminating microorganisms, while not leaving behind residues or components of themselves which could be directly dangerous to humans who contact them. Further, disposal of used products can also present concerns as they often remain toxic.

The joint push for plant-based products and for products which may be effective antimicrobials without having as great a danger to humans has resulted in push to locate plant based cleaners and disinfectants. Because plants are typically natural prey to bugs and microorganisms, it has been discovered that many plants that were already in common use by humans for other purposes are highly effective producers of antimicrobials as the plants effectively produced antimicrobial chemicals as part of their own protection. Oils from plants such as cinnamon, lemongrass, basil, lavender, citronella, and tea tree have all provided effective antimicrobials. Further, products such as mustard seed are desired as a human spice precisely because of their evolved toxicity to smaller lifeforms. Further, naturally occurring acids, primarily citric acid and lactic acid, have also proven to be effective antimicrobials.

In many respects, the fact that many plants include natural antimicrobials should be obvious. The human immune system, as discussed above, is built to attack and destroy invading microorganisms and one would expect that plants, and other animals, would do the same. Plants, however, due to their position generally opposite the animals of the earth, provide a particularly intriguing source of raw materials and their defense response is also readily captured from their structure. Typically, it is recognized that keeping the amount of plants and animals on earth in good balance should allow the population of humanity to greatly increase while not reducing the ability of the earth to successfully sustain them. This can be beneficial for everyone (and everything).

SUMMARY

The following is a summary of the invention in order to provide a basic understanding of some aspects of the invention. This summary is not intended to identify key or critical elements of the invention or to delineate the scope of the invention. The sole purpose of this section is to present some concepts of the invention in a simplified form as a prelude to the more detailed description that is presented later.

Because of these and other problems in the art, described herein is a process for effectively binding plant-based antimicrobials to various fabrics which provides for long term antimicrobial effect of the fabric and the resultant fabric.

There is described herein, among other things, a method of forming an antimicrobial fabric (and the resultant fabric), the method comprising: providing an aqueous solution comprising from 1% to 20% tea tree oil, from 1% to 20% citric acid, from 1% to 20% of a binder, and from 0.5% to 5% of an emulsifier; exposing a fabric to the aqueous solution for a period of time; and drying the fabric after the exposing.

In an embodiment of the method, the aqueous solution further comprises 0% to 5% of a defoamer.

In an embodiment of the method, the defoamer comprises a nonionic non-silicone defoamer In an embodiment of the method, the defoamer comprises an oil-based defoamer.

In an embodiment of the method, the defoamer is made up mostly of petroleum products, In an embodiment of the method, the binder comprises a polymer that serves to crosslink reactive end groups of the solution to the fabric surface.

In an embodiment of the method, the binder comprises a polar aprotic solvent.

In an embodiment of the method, the binder comprises N-methyl-2-pyrrolidone (e.g. NMP), dimethylformamide, dimethylsulfoxide, dimethylacetamide, or Hexamethylphosphoramide (HMPA).

In an embodiment of the method, the emulsifier comprises a non-ionic surfactant.

In an embodiment of the method, the emulsifier comprises polyoxyethylene castor oil, ethoxylated castor oil, or polyoxl n castor oil (n=40-60).

In an embodiment of the method, the exposing includes a wet process with the aqueous solution being applied to the fabric with an application load level of between 1% and 20%.

In an embodiment of the method, the application load level is between 5% and 15%.

In an embodiment of the method, the wet process comprises a continuous "Pad-Dry" process.

In an embodiment of the method, the wet process comprises an "exhaust" process.

In an embodiment of the method, the drying comprises: placing the fabric on a tenter frame containing heating zones which activate the binder.

There is also described herein, in various embodiments, an antimicrobial fabric comprising: interconnected synthetic fibers; the interconnected synthetic fibers having been exposed to an aqueous solution comprising from 1% to 20% tea tree oil, from 1% to 20% citric acid, from 1% to 20% of a binder, from 0.5% to 5% of an emulsifier, and from 0% to 5% of a defoamer for a period of time and then dried.

In an embodiment of the fabric, the defoamer comprises an oil-based defoamer made up mostly of petroleum products.

In an embodiment of the fabric, the binder comprises N-methyl-2-pyrrolidone (e.g. NMP), dimethylformamide, dimethylsulfoxide, dimethylacetamide, or Hexamethylphosphoramide (HMPA).

In an embodiment of the fabric, the emulsifier comprises polyoxyethylene castor oil, ethoxylated castor oil, or polyoxl n castor oil (n=40-60).

In an embodiment of the fabric, the exposing includes a wet process with the aqueous solution being applied to the fabric with an application load level of between 1% and 20%.

BRIEF DESCRIPTION OF THE DRAWINGS

FIG. 1 shows a comparison of the antimicrobial properties of fabrics treated with tea tree oil alone, citric acid alone, a combination of tea tree oil and citric acid, and the combination of tea tree oil and citric acid, and the combination of tea tree oil, citric acid, and an emulsifier. All the efficacies are shown after 50 washings and two different times of exposure.

DESCRIPTION OF PREFERRED EMBODIMENT(S)

As discussed herein, the terms "thread", "yarn," and "fiber" are often used interchangeably although those terms are often provided with specific meaning in the art. However, they are all, in some respects, the act of interconnecting "filaments" to form suitable materials for fabric construction. Further "fabric" as used herein will generally comprise any form of material made through the interconnection of any combination of filaments, threads, yarns, or fibers. Although the fabrics may be described as a woven material, this description is not intended to be limited only to weaves and woven material, those are simply a common and well understood example. Materials and fabrics within the scope of this disclosure include without limitation any materials woven, knitted, bound, bonded, crocheted, knotted, tatted, felted, braided, or otherwise formed. Such materials include fabrics or other materials formed by application of heat and/or pressure to filaments or other materials. For example, and without limitation, this application includes within its scope non-woven materials made to form fabrics that are not woven or knitted, such as felts. Accordingly, as would be appreciated by a person of ordinary skill in the art, the teachings herein are applicable to fabrics made by any method known to persons of ordinary skill in the art. Further, the use of the term "garment" as used herein is primarily to indicate any article of clothing and particularly those constructed from a fabric. However, it should be recognized that the systems and methods discussed herein can be used on other fabric objects which may not be garments, or which may occasionally be used as garments even if it is not their primary purpose.

Essential oils of various plants are used in a large number of human applications. They are commonly used for flavoring in cooking as well as in various skin creams, balms, and salves. In many respects, essential oils can be considered a distillation of the chemical composition of a plant into a particularly concentrated form. Most have a strong scent or taste which is often what they are valued for (for example, vanilla or orange oil), however, it has recently been discovered that many plant oils may have other properties. One of these is that many of them are relatively strong antimicrobials. One of the most effective plant-based antimicrobial compounds is Terpinen-4-ol. It is an isomer of terpinol and a monoterpene and is found in a number of plants including in oranges, mandarins, oregano, New Zealand lemonwood tree, Japanese cedar and black pepper. However, it is most known as being a primary component of tea tree (Maelaleuca alternifolia) oil. Terpinen-4-ol is known to have, at least, strong antibacterial and antifungal properties and has been placed into a variety of human uses in body products.

While tea tree oil is an effective antimicrobial, its traditional uses are on the skin where it is either absorbed to assist the skin's own auto-defense functions, or is placed into direct contact with microbes whose elimination is desired (such as in the treatment of wounds). In fabric, tea tree oil is generally an ineffective antimicrobial as it is readily removed by laundering and therefore lacks the ability to function over a time of extended use. After as few as ten washings, the effectiveness of tea tree oil treated fabric has typically fallen well below the level as to be effective.

Effectiveness of an antimicrobial is typically measured by its elimination capability. No antimicrobial will completely kill all microbes which it ends up in proximity to, however, a significant reduction in concentration is effectively complete removal as the small amount remaining are typically unable to reproduce fast enough to avoid destruction from a human immune system, or to simply not be noticed (e.g. in the case of odor causing bacteria). Elimination of greater than 99% of a particular form of microbe is typically required for a product to be considered antimicrobial and most actually destroy around 99.9% to 99.99% of such microbes. Tea tree oil is known to destroy well over 99.9% of bacteria and can do so when impregnated into fabric. However, after just 25 washings, the effectiveness can have fallen to as low as 65% which is, most all intents and purposes, sufficiently low as to have no noticeable antimicrobial effect.

Citric Acid is also known to be an antiviral although it is more commonly used as a pH adjuster, chelating agent, or preservative in various cleaners. Citric Acid is primary encountered naturally in citrus fruits (such as lemons, limes and oranges) and it is what gives them their tart sour flavor. However, it may be produced at large scale via molds or through certain synthesis reactions. Citric acid is naturally produced in a large number of plants as citrate, which is a primary part of the TCA cycle present in the central metabolic pathway.

In order to provide for an effective antimicrobial fabric which obtains its antimicrobial properties from plant-based materials, it is desirable to provide a blend of citric acid and tea tree oil. The blend will typically be provided to the fabric or to the underlying yarns as a topical treatment where it can be bound to the fabric or yarn via a binding agent. This will typically occur once the fabric has been constructed into a garment but may occur at the fabric or thread stage. The fabric to which it is applied may be natural (e.g. wool or cotton) or may be from synthetic fibers (such as polyester or spandex). The synthetic fibers may be virgin fibers or may be recycled from other materials. In an alternative embodiment, if the fabric is intended to have antimicrobial properties when manufactured, the binding agent may be included as part of such synthetic fibers during manufacturing to prepare the yarn or fabric for exposure to the tea tree oil and citric acid blend. This is, however, generally not preferred.

Synthetic fibers are particularly common in exercise clothing due to their light weight, quick dry, stretchability, and skin hugging capability. As this type of clothing is also one which is commonly exposed to large amounts of sweat, it can also be subject to substantial odor between launderings. Further, injuries during exercise and sports can also regularly occur which can make microbial colonies in exercise clothing particularly dangerous. For at least these reasons, providing antimicrobial capability to fabric including synthetic fibers (either alone or in combination with natural fibers) can be particularly valuable. However, synthetic fiber-based fabrics can also be more difficult to effectively impregnate with other materials due to the structure of synthetic fibers when compared to more naturally occurring fibers.

As indicated above, the present invention comprises a mixture of tea tree oil and citric acid along with a binder being used as a treatment for fabrics. The mixture will typically be applied in an aqueous solution in the same manner as a fabric dye or treatment with the solution acting as the liquor bath in the treatment process. The solution may comprise, in an embodiment, from 1-20% tea tree oil, from 1-20% citric acid, from 1-20% binder, from 0.5%-5% emulsifier, from 0%-5% defoamer, and with the remainder of the solution comprising water.

The treatment will be applied to the fabric via any form of fabric wet process methodology. Typically, the solution will be applied to the fabric with the specific application load level of the solution being around 1-20% with 5-15% typically being more preferred. However, the specific amount of solution used for a fabric may depend on the particular type of fabric, and the specific fiber content of the fabric to which the solution is being applied, as well as the treatment methodology used. In many cases, the fabric will comprise a fabric including both synthetic and natural fibers in combination. However, such solutions may also be used on fabrics formed of purely synthetic fabrics (either of uniform fiber type or with combinations of fibers of different types) or on fabrics including only natural fibers (again including those of uniform fiber type or with combinations of fibers of different types).

In an embodiment, the fabric would be treated using a continuous "Pad-Dry" method for fabric finishing as that term is commonly understood by one of ordinary skill in the art. In such a method, a continuous roll of fabric would typically be immersed in a trough containing a particular strength of the antimicrobial solution and then padded through rubber squeeze rollers (also called a mangle or wringer) to impart a consistent wet pick up level. The pad operation is normally on the entry end of a tenter frame which contains heating zones used to dry the fabric and impart durability from activating the binder.

Alternatively, the fabric may be treated using the "exhaust" method of wet processing where a certain weight or length of fabric (a "batch") will typically be placed within a bath of the solution (liquor) and "exhausted" on to the fabric at elevated temperatures for a specified period of time before it is removed. The fabric is then run down the tenter frame as previously mentioned to dry the fabric and impart durability. Exhaust methods typically utilize a jet machine but can be accomplished by other machines such as a jigger, winch, beam, or garment machine. As previously mentioned above, the specific application load level of the solution in any of the above methodologies will typically be within the same 1-20% and often within 5%-15%.

The binder present in the solution can comprise a variety of binders and essentially serves to provide chemical attachment to the surface of the fabric to impart further durability for maintaining the citric acid and/or tea tree oil to the fabric through extended laundering cycles. The binder, in an embodiment, will be a polymer that serves to crosslink reactive end groups of the solution to the fabric surface. While a variety of binders can be used and may be altered depending on the composition of the substrate fabric, in many cases the binder will comprise a polar aprotic solvent such as, but not limited to, N-methyl-2-pyrrolidone (e.g. NMP), dimethylformamide, dimethylsulfoxide, dimethylacetamide, or Hexamethylphosphoramide (HMPA). The binder may be activated by heat in the drying process or via another mechanism.

The emulsifier present in the solution can comprise a variety of emulsifiers and is primarily included to provide viscosity and stability to the solution as would be understood by a person of ordinary skill in the art. A the same time, as shown in FIG. 1, inclusion of a emulsifier of certain types can improve retention of the tea tree oil and citric acid combination in the fabric. The emulsifier, in an embodiment, will be a non-ionic surfactant such as those typically used in dyeing or other aspects of the manufacture of fabric and may have a pH of about 5.5 to about 8.0 (in 5% solution). In an embodiment, the emulsifier comprises polyoxyethylene castor oil, ethoxylated castor oil, polyoxl n castor oil (n=40-60), or any similar compound or combination of compounds.

The defoamer present in the solution can comprise a variety of defoamers and/or antifoamers and is primarily included to provide for foam control during processing as would be understood by a person of ordinary skill in the art. In an embodiment, the defoamer will comprise a nonionic non-silicone defoamer for aqueous solutions. This will often comprise an oil-based defoamer made up mostly of petroleum products, but oil-based materials may also be based on synthetic oils, vegetable oils, or other oils. The defoamer will typically have a pH of about 6.0 to about 7.0 in 2% solution As can be seen in FIG. 1, fabrics treated with just tea tree oil and binder (101), after 50 washings, have essentially lost all effective antimicrobial capability (with elimination at best below 80% even after 24 hours of exposure) and also show wide variability in antimicrobial capability with one sample retaining essentially no capability at all. Fabrics treated with just citric acid and binder (103) show improved performance with elimination in the 80% or higher range, but the fabrics still have wide variability and lack consistent elimination in the 90%, 95%, 99%, 99.9%, or 99.99% range which are often required to be effective antimicrobial materials.

However, as can be seen toward the right of FIG. 1, fabrics treated with a combination of tea tree oil, citric acid, and binder (105) in the manner discussed above are still strongly antimicrobial and are clearly more consistently antimicrobial than one treated with just one of the constituents. With the combination, elimination in the upper 90% range is obtained even after the shorter window of exposure while near 100% elimination is obtained in the longer exposure window. Still further, a combination of tea tree oil, citric acid, binder, and polyoxyethylene castor oil (107) shows strong maintenance of antimicrobial capability of essentially 100% even after 50 washings. From this FIGURE, it is clear that the combination of materials as contemplated above unexpectedly outperforms either material alone and what would be expected from the combination based on the individual performance of the constituents.

The qualifier "generally," and similar qualifiers as used in the present case, would be understood by one of ordinary skill in the art to accommodate recognizable attempts to conform a device to the qualified term, which may nevertheless fall short of doing so. This is because terms such as "circular" are purely geometric constructs and no real-world component or relationship is truly "circular" in the geometric sense. Variations from geometric and mathematical descriptions are unavoidable due to, among other things, manufacturing tolerances resulting in shape variations, defects and imperfections, non-uniform thermal expansion, and natural wear. Moreover, there exists for every object a level of magnification at which geometric and mathematical descriptors fail due to the nature of matter. One of ordinary skill would thus understand the term "generally" and relationships contemplated herein regardless of the inclusion of such qualifiers to include a range of variations from the literal geometric meaning of the term in view of these and other considerations.

While the invention has been disclosed in conjunction with a description of certain embodiments, including those that are currently believed to be useful embodiments, the detailed description is intended to be illustrative and should not be understood to limit the scope of the present disclosure. As would be understood by one of ordinary skill in the art, embodiments other than those described in detail herein are encompassed by the present invention. Modifications and variations of the described embodiments may be made without departing from the spirit and scope of the invention.

It will further be understood that any of the ranges, values, properties, or characteristics given for any single component of the present disclosure can be used interchangeably with any ranges, values, properties, or characteristics given for any of the other components of the disclosure, where compatible, to form an embodiment having defined values for each of the components, as given herein throughout. Further, ranges provided for a genus or a category can also be applied to species within the genus or members of the category unless otherwise noted.

The invention claimed is:

1. A method of forming an antimicrobial fabric, the method comprising:

providing an aqueous solution consisting esentially of from 1% to 20% by weight tea tree oil, from 1% to 20% by weight citric acid, from 1% to 20% by weight of a binder, from 0.5% to 5% by weight of an emulsifier, and from 0% to 5% by weight of a defoamer, exposing a fabric to said aqueous solution for a period of time; and drying said fabric after said exposing.

2. The method of claim 1 wherein said aqueous solution further comprises greater than 0% a defoamer.

3. The method of claim 2 wherein said defoamer comprises a nonionic non-silicone defoamer.

4. The method of claim 3 wherein said defoamer comprises an oil-based defoamer.

5. The method of claim 4 wherein said defoamer is made up mostly of petroleum products.

6. The method of claim 1 wherein said binder comprises a polymer that serves to crosslink reactive end groups of the solution to the fabric surface.

7. The method of claim 6 wherein said binder comprises a polar aprotic solvent.

8. The method of claim 7 wherein said binder comprises N-methyl-2-pyrrolidone (e.g. NMP), dimethylformamide, dimethylsulfoxide, dimethylacetamide, or Hexamethylphosphoramide (HMPA).

9. The method of claim 1 wherein said emulsifier comprises a non-ionic surfactant.

10. The method of claim 9 wherein said emulsifier comprises polyoxyethylene castor oil, ethoxylated castor oil, or polyoxl n castor oil (n=40-60).

11. The method of claim 1 wherein said exposing includes a wet process with said aqueous solution being applied to the fabric with an application load level of between 1% and 20%.

12. The method of claim 11 wherein said application load level is between 5% and 15%.

13. The method of claim 11 wherein said wet process comprises a continuous "Pad-Dry" process.

14. The method of claim 11 wherein said wet process comprises an "exhaust" process.

15. The method of claim 1 wherein said drying comprises:

placing said fabric on a tenter frame containing heating zones which activate the binder.

16. The method of claim 1 wherein said fabric maintains antimicrobial capability after 50 washings.

17. The method claim 16 wherein said antimicrobial capability is elimination of at least 90% of microbes.

18. The method claim 16 wherein said antimicrobial capability is elimination of at essentially 100% of microbes.

19. A method of forming an antimicrobial fabric, the method comprising:

providing an aqueous solution consisting of from 1% to 20% by weight tea tree oil, from 1% to 20% by weight citric acid, from 1% to 20% by weight of a binder, from 0.5% to 5% by weight of an emulsifier, and from 0% to 5% by weight of a defoamer, with the remainder comprising water;

exposing a fabric to said aqueous solution for a period of time; and drying said fabric after said exposing.

* * * * *